United States Patent [19]

Ohrenstein et al.

[11] 4,091,443

[45] May 23, 1978

[54] MULTIPURPOSE LIGHT WITH MIRROR

[76] Inventors: Henry Ohrenstein, 239 Concord Rd.; Sharon L. Wells, 224 Pennell Rd., Aston Arms, Apt. G-4, both of Aston, Pa. 19014

[21] Appl. No.: 714,837

[22] Filed: Aug. 16, 1976

[51] Int. Cl.[2] ..... A45C 15/06

[52] U.S. Cl. ..... 362/156; 362/31; 362/103; 362/140

[58] Field of Search ..... 240/6.45 P, 6.45 R, 240/6.4 W, 6.4 R, 4.2, 1 EI

[56] References Cited

U.S. PATENT DOCUMENTS

| | | | |
|---|---|---|---|
| 2,276,370 | 3/1942 | Conrad | 240/6.45 R |
| 2,515,437 | 7/1950 | Bisch et al. | 240/6.45 R |
| 2,611,573 | 9/1952 | Young | 240/6.45 P |
| 3,083,295 | 3/1963 | Baker | 240/6.4 W |
| 3,305,679 | 2/1967 | Barcita-Peruchena | 240/6.45 R |
| 3,330,949 | 7/1967 | Bush | 240/6.45 P |
| 3,908,119 | 9/1975 | Zeytoonian | 240/6.45 R |

*Primary Examiner*—Richard L. Moses

*Attorney, Agent, or Firm*—Clarence A. O'Brien; Harvey B. Jacobson

[57] ABSTRACT

A multipurpose light with mirror for use with a lady's handbag, or use with articles of wearing apparel to assist the wearer in performing operations at night which without sufficient light would be unsafe or difficult to perform. The basic structure is a container made of light diffusing and transmitting material having energy cells or batteries contained therein together with two light emitting devices, all connected with appropriate wiring and a three-way switch. The switch permits one of the light devices to provide light for illumination of the light diffusing and transmitting border of the container, while another position of the switch turns off this light and turns on the other illuminating device for projecting a beam of light away from the container. Fastening means are provided along one surface of the container for attachment of the overall device to the interior of a lady's handbag, or to the back of a wearer's jacket, the back of a user's glove, the front of a wearer's cap, the interior of an attache case, and the like. Another surface of the container is provided with a mirror which is so mounted that the soft diffused light of the light transmitting and diffusing border and container will softly light the mirror with glare free illumination. Thus, the user may use the light and mirror combination to put on proper makeup, or the device will softly illuminate itself to serve as a safety and warning device if being worn by the user. Also, the device when using the second light emitting structure will provide sufficient light for performing job tasks and emergency repairs, etc.

7 Claims, 5 Drawing Figures

MULTIPURPOSE LIGHT WITH MIRROR

BACKGROUND OF THE INVENTION

1. Field of the Invention

This invention relates generally to a multipurpose light device having a mirror thereon usable as a soft glare free source of illumination as well as providing a means for lighting areas for finding articles or making repairs, etc.

2. Description of the Prior Art

A common problem with known type devices for lady's handbags and the like is that they fail to provide both a soft illumination for a user putting on makeup as well as a source of illumination for finding articles within the interior of the handbag.

Another problem with known devices is that they are not readily detachable and removable for replacement of the batteries or energy cells contained therein. Or, in the case of a change of handbags from one style to another, the known type devices must be provided for each and every handbag rather than using the same one interchangeably with the different handbags. Obviously, to provide a lighting device for each and every handbag would be quite expensive since many ladies have a great number of such handbags.

Another problem with known devices is that they are limited to a specific use and function and are not multipurpose devices. A multipurpose device has many advantages in that it may be manufactured, distributed, and sold to a great number of users for many different purposes and applications. This greatly enhances the marketability and promotional possibilities of the overall device.

Another known problem of prior art devices is that they fail to provide both a source of soft glare free illumination for a mirror to be used by ladies as well as another source of illumination in order to find lost articles, make emergency repairs, or as a safety device.

Known prior art patents which may be pertinent to this invention are as follows:

U.S. Pat. Nos. 2,276,370; Mar. 17, 1942;
U.S. Pat. Nos. 2,325,476; July 27, 1943;
U.S. Pat. Nos. 2,554,603; May 29, 1951;
U.S. Pat. Nos. 2,691,091; Oct. 5, 1954;
U.S. Pat. Nos. 3,307,027; Feb. 28, 1962;
U.S. Pat. Nos. 3,330,949; July 11, 1969.

None of these known prior art devices offers the new and unique features of the invention disclosed herein.

SUMMARY OF THE INVENTION

An object of this invention is to provide a multipurpose light for use in a number of different applications. The primary object is to provide in a single unit, a lighting system that will enable a user to illuminate a mirror associated with the device with a soft glare free type of illumination, together with a second light source that will enable a user to illuminate adjacent areas, such as the interior of a handbag, or the engine compartment of an automobile, or the trunk compartment of an automobile.

Another object of this invention is to provide a multipurpose light device which has ready attachment means for quick and easy fastening of the light upon a piece of the user's wearing apparel, or on the interior of a lady's handbag and the like.

A further object of this invention is to provide a multipurpose light having a plurality of switch positions in order to turn on and off several sources of light from the overall device. One position of the switch will provide soft glare-free illumination through a light transmitting and diffusing border surrounding a mirror arranged on one surface of the device in order to provide shadow free, non-glaring light on the mirror surface and on the face of a user using the mirror, for example, in checking or applying cosmetic makeup. Another position of the switch provides a second source of illumination of a projecting or direct beam type in order to illuminate adjacent areas to the multipurpose light for the purpose of finding articles and/or making repairs, or providing a safety and warning signal device.

A still further object of this invention is to provide a multipurpose light having readily detachable fastening structure mounted on a surface thereof to enable a user to fasten the device to the interior of a handbag, or to the back of one's jacket, or the back of one's glove, or to the front of a cap or hat being worn by the user, or to the sun visor of an automobile, or to the interior of a briefcase or attache case.

Another further object of this invention is to provide such fastening means to render the device easily transferable from one type of use or application to another without difficulty or the need of a great amount of time. Also, this easy removable fastening means permits ready removal of the multipurpose light in order to change energy cells, batteries or bulbs contained therein.

A still further additional object of this invention is to provide a multipurpose light which is of simple design, inexpensive to manufacture, and can be easily removed from the applicable structure with which it is currently being used for repair or component replacement without depriving the user of the services of the article with which it is formally associated.

The multipurpose light of this invention is constructed of basic light diffusing and transferring material such as Lucite which will permit a mirror mounted upon one surface of the device to be softly illuminated with shadow-free and glare-free light. Internal components of the device consist of necessary batteries or energy cells, appropriate wiring, switch means and at least two light emitting devices appropriately connected with the aforesaid components in order to provide at least two sources of light. When the switch is in a first on position, one of the light emitting devices provides light to the lucite border of the device to softly illuminate the mirror associated therewith. The second position of the switch turns off this mirror illumininating device and turns on a second light emitting device in order to project a beam of light external of the overall device. It permits the user of the device to project a beam of light to inaccessible and dark spots such as within a lady's handbag, within an automobile engine compartment, or within the trunk of an automobile.

Another important feature of this multipurpose light is that an easy detachable and fast fastening structure is provided on the device to permit ready and quick attachment of the device to the interior of a lady's handbag or the interior of an attache' case and the like to provide illumination of the interior of the handbag or case. The detachable means for fasten within said interiors also permit quick and easy detachment of the device so that the internal components may be replaced or repaired when necessary.

Another very important application of this multipurpose light device is that with the quick fastening means provided on the device it may be readily attached to the back of a wearer's jacket or on the sleeve thereof for the purpose of a safety device, for example, to act as both a reflector at night and as a safety warning light indicating device. It may be worn by motorcycle or bicycle riders and will be a great benefit safetywise. Or, walking down a highway at night, the bright reflectory effect of the soft illumination of the mirror together with the reflection of the mirror itself from the beams of oncoming automobile headlights, will as is obvious, increase the safety of the user and wearer.

Also, the device may be quickly and easily attached to the back of a user's glove to enable the wearer to put a concentrated light source directly on a work area. Such an example being when doing minor repairs or emergency repairs under the hood of an automobile in the engine compartment or in the trunk of said automobile when trying to find the jack or spare tire, etc.

While the multipurpose light has been specifically shown applicable to the interior of a lady's handbag, it also may be used on the interior of a briefcase or attache case. Use and function in such a case would be very similar to that of the lady's handbag. The light could be used in an attache case in an automobile such as a police car or an emergency vehicle in order to make reports or find necessary articles contained within said case.

Another application would be by attaching the multipurpose light device of this invention to a cap or hat of a user. This would enable the user to put a concentrated beam of light on the work area just above or in front of the user's head and permit the wearer full use of both hands while doing any necessary repair or maintenance work.

The light could also be attached to the sun visor of an automobile for use as a makeup light and just as easily detached should the user desire to use it with another application or for another purpose.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
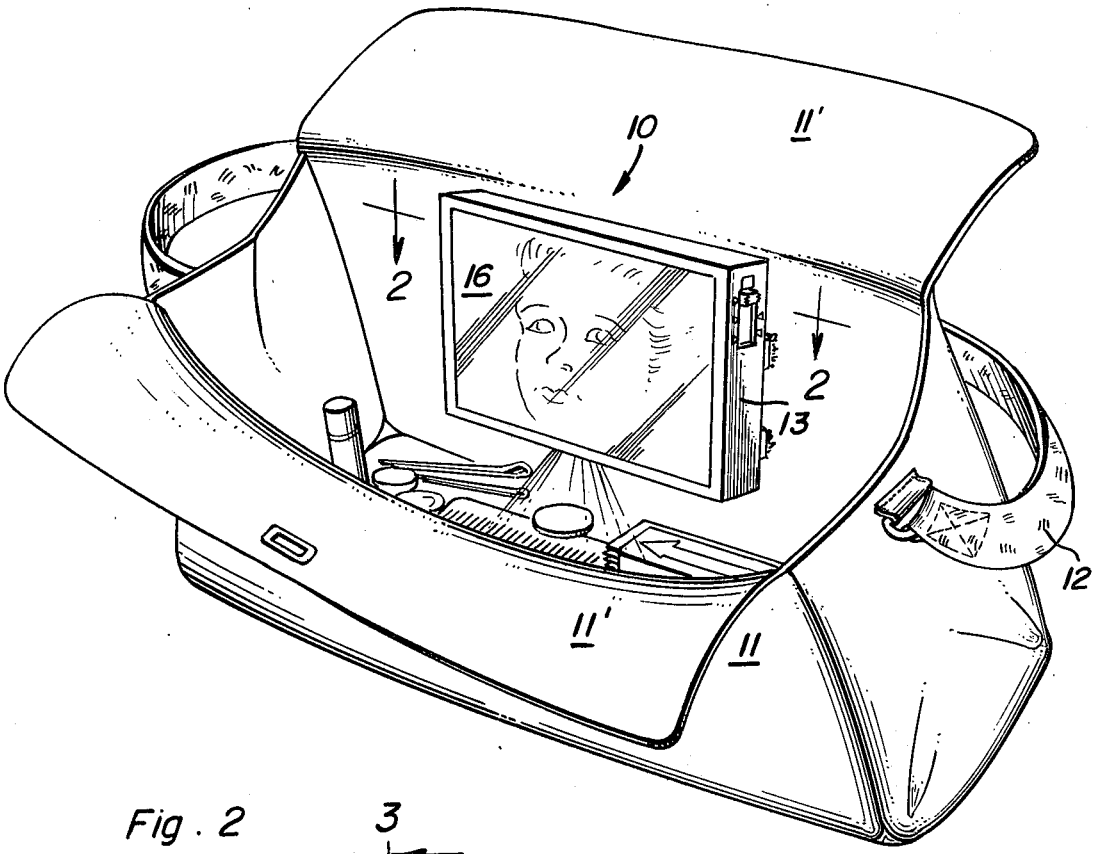
FIG. 1 is a perspective view of the multipurpose light of this invention as in use in a lady's handbag.
Figure 2:
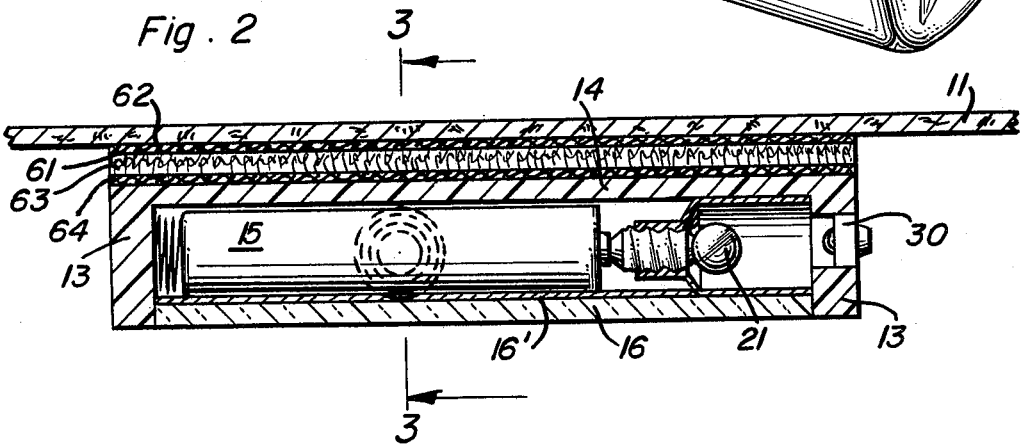
FIG. 2 is an enlarged, cross-sectional view taken generally along line 2—2 of FIG. 1.
Figure 3:
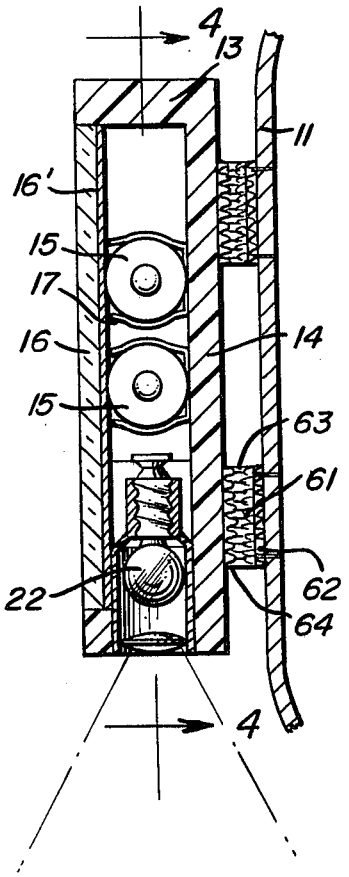
FIG. 3 is an enlarged, cross-sectional view taken generally along line 3—3 of FIG. 2.

Referring to FIG. 1 of the drawings, reference numeral 10 indicates in general the multipurpose light of this invention as in use in a lady's handbag. The handbag indicated by reference numeral 11 has opening flaps 11' at the top thereof and a strap or handle 12 also provided. Mounted within the handbag is the multipurpose light of this invention. The light device is provided with a primary rectangularly-shaped body member having walls 13 and a back 14. The structure is made of a material which is semi-translucent or semi-opaque and preferably will transmit and diffuse light through the interior thereof. Material such as polymerized methyl methacrylate sold under the registered trademark "Lucite" has been found to be ideal for this purpose. The side of the container opposite to the back 14 is formed by a mirror 16 having conventional mirror reflecting surface 16' on the inside thereof as best seen in FIGS. 2 and 3.

Figure 4:
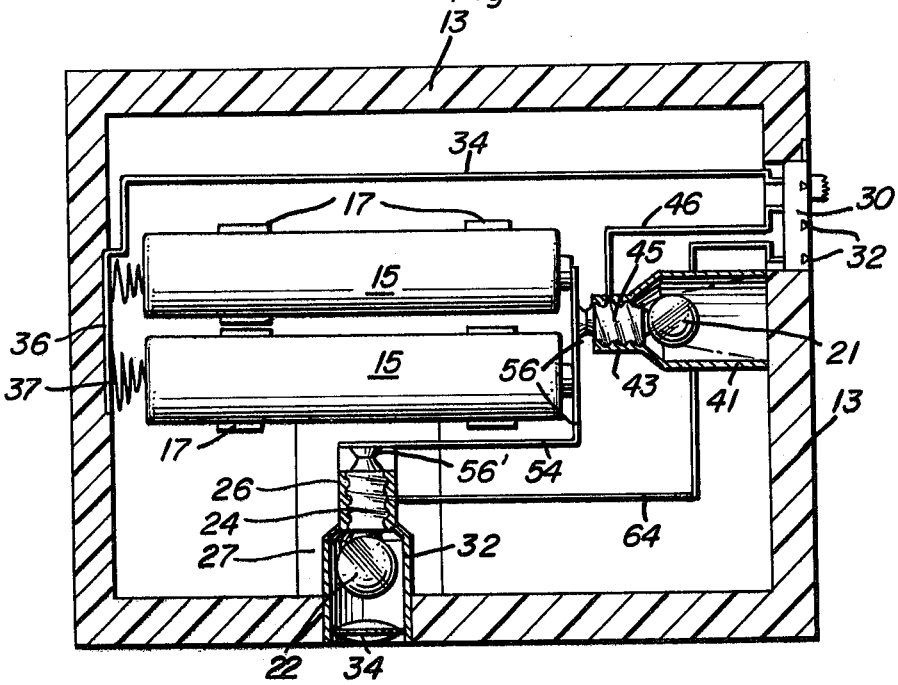
FIG. 4 is an enlarged, cross-sectional view taken generally along line 4—4 of FIG. 3.

Appropriately mounted within the container are energy cells or batteries 15 to be retained therein by spring clips 17 or the like. Looking at FIG. 4 of the drawings, the first illuminating device consists of bulb 21 having a base portion 45 screwed into a socket 43 and a light shield 41 provided therewith. This structure permits the light emitted by the bulb 21 to be conveyed to and confined in the panel walls 13 which in turn illuminate the mirror 16 with a soft glare free light when the bulb 21 is energized. A contact portion 56 engages with the positive leads of the energy cells 15 and also engages with the center contact of the bulb 21. An electrical connection is made by wire 46 between the outer portion of the base 41 of light 21 to the switch 30. Another electrical wire 34 connects to the negative polarity of the energy cells 15 by means of contact plate 36 and contact springs 37. This wire 34 in turn connects to the switch 30 for current flow when the switch 30 is moved to the first on position for lighting and energization of the bulb 21. Indicia 32 are properly provided adjacent to or on the switch 30 for ready identification of the proper switch positions. The first position of the switch is the off position, while the second position is the one for energizing the light bulb 21.

The second illuminating device consists of a bulb 22 mounted along the bottom wall portion of the container. This bulb 22 has an appropriate base 24 screwed into a receptacle 26 and light guide shield 32. A magnifying type lens 34 is also provided to concentrate the rays of the light emitted from bulb 22 to form a beam of light projecting from the device. Another center tip contact 56' is provided within the mounting structure 27 and connected by wire 54 to the plus contact engaging strip 56 already described. Another wire 64 connects the outer terminal portion of the base 24 to the third position of switch 30.

Figure 5:
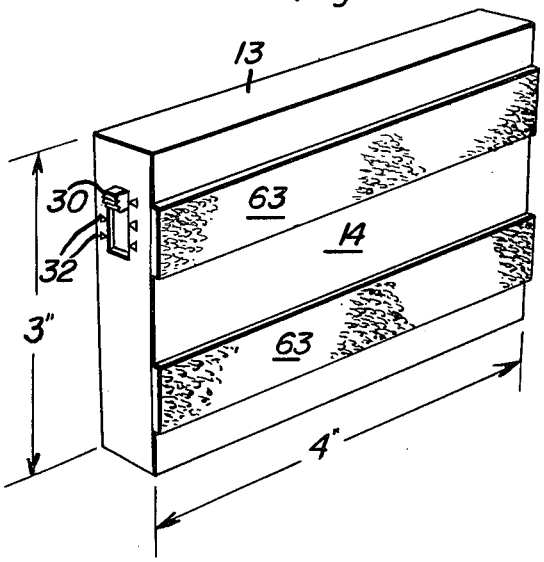
FIG. 5 is a perspective view of the back of the multipurpose light of this invention showing the fastening structure of the device.

The approximate outer dimensions of this device as shown in FIG. 5 measure approximately $3 \times 4$. The thickness is basically slightly greater than the thickness of the energy cells being used. The mirror 16 contained with the wall portions 13 of the device measures approximately $2\frac{1}{2} \times 3\frac{1}{2}$. A mirror is recessed into the wall portion 13 so that the light carried throughout the walls 13 from the bulb 21 will extend into the glass portion 16 of the mirror and softly illuminate same as well as casting a soft illumination upon the face of the person looking into said mirror. This type of illumination is ideal for the purpose of applying and affecting makeup as is so often used by ladies.

The back side 14 of the multipurpose light of this invention is appropriately provided with several fastening strips to permit quick and easy attachment to a lady's handbag or other appropriate devices. Such devices as have been indicated in the description above could be an attache case, a briefcase, or articles of wearing apparel of the user, such as a cap, a glove, a jacket, etc. Preferably the strips 63 are of an adhering material of the male type, such as that sold under the registered trademark "Velcro", while as shown in FIGS. 2 and 3, the article of clothing or the innerside of a lady's handbag 11 has appropriate female complementary strips 61, 62 attached thereto. When this multipurpose light is distributed and sold several extra strips of complementary adhering material may be supplied therewith for permitting attachment to various articles of the user. This as is obvious will permit the user to change and use the multipurpose light with the various desired articles in a quick, simple, and efficient manner.

In use the switch 30 normally would be in the first position which is off. When the switch is moved to the first on position, the bulb 21 will be energized from the energy cells and will emit soft glare free light around the body portion and onto the mirror surface and the face of the user. By merely flipping or moving the slide switch 30 to the third position, the light 21 is turned off and light 22 is energized. Then a beam of concentrated light will be projected downwardly from the device as shown and will illuminate the interior of a lady's handbag. Thus, the user may readily find her car keys, lipstick, or whatever in the bottom of the bag. Obviously, when the device is used on an article of clothing such as on the back of a glove when the light 22 is energized, then the projected beam of light will illuminate the interior of an automobile engine compartment, or the interior of a automobile trunk, etc. From this description one can readily visualize how useful this multipurpose light can be for many different applications.

While the energy cells 15 are shown as being connected in parallel and separately energize the lights 21 and 22 through the switch 30, it is envisioned within the concept of this invention that said cells may be connected in series, and will operate higher voltage bulbs than at present, and also envisioned that instead of said cells being in parallel, as shown and described above, said cells may be individually connected to the respective bulbs 21 and 22 through an appropriate switch so that it will create in effect a redundancy or backup system. That is, if one cell or bulb should fail, the other cell or bulb still would be operational.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A portable light device comprising; a lightweight box-like, hollow rectangularly shaped body member having planar walls and a back, and constructed from a material which is light diffusing and transmitting, at least one light emitting device, mounted on one of the walls of the body member, and arranged for conveying light directly to the same one of the walls and confining the light emitted to the walls and back of the body member, and electric circuit means disposed within the body member for connecting and disconnecting the light emitting device to and from an energy cell arrangeable within the body member.

2. The structure as set forth in claim 1, wherein the at least one light emitting device is two light emitting devices provided on the body member, one of said light emitting devices being arranged with respect to the material of the body member in order to cast a soft glare free light upon the user of the device.

3. The structure as set forth in claim 2, wherein the other of the light emitting devices is arranged in another of the walls of the body member different than the one of the walls on which said one of the light emitting devices is mounted, said other of the light emitting devices being mounted for directing a concentrated beam of light away from body member for use in illuminating areas adjacent to the body member.

4. The structure as set forth in claim 3, together with removable fastener means mounted on the body member so the device can be worn on an article of clothing for use in illuminating the adjacent area for hands free use of the multipurpose light device.

5. The structure as set forth in claim 4, wherein the electric circuit means includes a switch electrically connected to the light emitting devices for actuating same.

6. The device as set forth in claim 5, together with a mirror mounted on the walls of the body member opposite to and spaced from the back of the body member with the mirror thus arranged for being illuminated with a soft glare free light by receiving the light emitted from the one of the light emitting devices, said light being confined to the walls and back of the body member.

7. The device as set forth in claim 1, together with a mirror mounted on the walls of the body member opposite to and spaced from the back of the body member, with the mirror thus arranged for being illuminated with a soft glare free light by receiving the light emitted from the at least one light emitting device, said light being confined to the walls and back of the body member.

* * * * *